US008944028B2

(12) United States Patent
Schnell et al.

(10) Patent No.: US 8,944,028 B2
(45) Date of Patent: Feb. 3, 2015

(54) VALVE DRIVE WITH ADDITIONAL LIFT IN THE CAM BASE CIRCLE

(75) Inventors: Oliver Schnell, Veitsbronn (DE); Peter Sailer, Erlangen (DE); Oliver Witter, Westhausen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/000,697

(22) PCT Filed: Jan. 30, 2012

(86) PCT No.: PCT/EP2012/051427

§ 371 (c)(1),
(2), (4) Date: Aug. 21, 2013

(87) PCT Pub. No.: WO2012/123160

PCT Pub. Date: Sep. 20, 2012

(65) Prior Publication Data

US 2013/0319358 A1 Dec. 5, 2013

(30) Foreign Application Priority Data

Mar. 15, 2011 (DE) ..... 10 2011 005 575

(51) Int. Cl.
*F02D 13/04* (2006.01)
*F01L 1/24* (2006.01)
*F01L 13/00* (2006.01)

(52) U.S. Cl.
CPC ..... *F01L 1/24* (2013.01); *F01L 1/2405* (2013.01); *F01L 13/0005* (2013.01); *F01L 13/0031* (2013.01); *F01L 13/0036* (2013.01); *F01L 13/00* (2013.01)
USPC ..... 123/321; 123/90.45

(58) Field of Classification Search
CPC ... F01L 2001/2444; F01L 9/02; F01L 1/2411; F01L 1/2416; F01L 1/24; F01L 1/2405; F01L 1/2422; F01L 1/255
USPC ..... 123/90.44, 320, 321, 90.43, 90.52, 123/90.55, 90.45, 90.46
See application file for complete search history.

(56) References Cited

U.S. PATENT DOCUMENTS 4,378,765 A 4/1983 Abermeth et al.
4,509,467 A 4/1985 Arai et al.

(Continued)

FOREIGN PATENT DOCUMENTS

DE 3003566 8/1981
DE 19930574 4/2001

(Continued)

*Primary Examiner* — Thomas Denion
*Assistant Examiner* — Daniel Bernstein
(74) *Attorney, Agent, or Firm* — Volpe and Koenig, P.C.

(57) ABSTRACT

A valve drive of an internal combustion engine, having a finger lever which acts at one end on a gas exchange valve and which is seated at the other end on a head of a housing of a support element, which housing runs in an axially movable manner in a reception bore of a cylinder head, the finger lever is acted on by a cam from the base circle from which there projects in a fixed manner an additional cam piece for generating an additional lift of the gas exchange valve, a bore extends from a bottom of the housing in the direction of the head, in the lower portion of which bore there runs a pressure piston which is axially movable relative to the housing and via the lower face of which the support element is mounted on a base of the reception bore of the cylinder head, a high-pressure chamber for hydraulic medium is formed between an upper face of the pressure piston and a ring part situated above said upper face and which is fixed with respect to the housing, and to generate the additional lift, the high-pressure chamber is flooded with hydraulic medium such that the housing is deployed relative to the pressure piston, supported on the hydraulic medium column accumulated in the high-pressure chamber, and to deactivate the additional stoke, the hydraulic medium in the high-pressure chamber is discharged such that the housing is retracted.

11 Claims, 2 Drawing Sheets

(56) References Cited

U.S. PATENT DOCUMENTS

| | | | | |
|---|---|---|---|---|
| 4,796,573 | A | 1/1989 | Wakeman et al. | |
| 4,867,113 | A | 9/1989 | Pieprzak et al. | |
| 4,881,499 | A * | 11/1989 | Dietrich et al. | 123/90.52 |
| 5,163,389 | A * | 11/1992 | Fujikawa et al. | 123/90.16 |
| 6,318,325 | B1 * | 11/2001 | Lechner | 123/90.55 |
| 7,047,925 | B2 * | 5/2006 | Hendriksma et al. | 123/90.45 |
| 7,900,597 | B2 * | 3/2011 | Meneely et al. | 123/323 |
| 8,272,363 | B2 * | 9/2012 | Meneely et al. | 123/323 |
| 8,312,861 | B2 * | 11/2012 | Ott et al. | 123/321 |
| 8,434,451 | B2 * | 5/2013 | Yoon et al. | 123/321 |
| 8,453,613 | B2 * | 6/2013 | Yang et al. | 123/90.12 |
| 8,813,719 | B2 * | 8/2014 | Sailer et al. | 123/321 |
| 2002/0069846 | A1 * | 6/2002 | Kunz | 123/90.55 |
| 2004/0050351 | A1 * | 3/2004 | Schmidt et al. | 123/90.12 |
| 2006/0070593 | A1 * | 4/2006 | Schmidt | 123/90.59 |
| 2008/0066704 | A1 * | 3/2008 | Cecur | 123/90.52 |
| 2009/0056653 | A1 * | 3/2009 | Schmidt et al. | 123/90.16 |
| 2013/0042835 | A1 * | 2/2013 | Hansson et al. | 123/321 |

FOREIGN PATENT DOCUMENTS

| | | |
|---|---|---|
| EP | 0634564 | 1/1995 |
| WO | 2006048101 | 5/2006 |

* cited by examiner

VALVE DRIVE WITH ADDITIONAL LIFT IN THE CAM BASE CIRCLE

BACKGROUND

The invention concerns a valve train of an internal combustion engine, said valve train comprising a cam follower acting on at least one gas exchange valve, said cam follower being loaded by a cam from whose base circle an optionally actuable additional cam piece for generating an additional lift of the gas exchange valve projects.

DE 30 03 566 A1 discloses a valve train whose camshaft comprises a control shaft that is axially displaceable in the camshaft. An additional cam projects out of the base circle of a cam of the camshaft illustrated in FIG. 1. This additional cam is received in a pocket of the cam for a radially outward movement out of the pocket. For obtaining an additional lift on the outlet valve, the control shaft can be displaced in axial direction such that a radial collar of the control shaft causes an outward movement of the additional cam.

A drawback of the aforesaid device is the immense structural complexity that leads to high costs. The camshaft must have a hollow configuration and comprise the additional control shaft. A complex and expensive operating device becomes necessary. In addition, it must be assured that the additional cam is not lost during phases of high rotational speed of the camshaft.

SUMMARY

It is therefore an object of the invention to provide a valve train comprising an additional lift in the cam base circle as stated above, but without the aforesaid drawbacks. In particular, it must be possible to create the additional lift in the cam base circle for realizing a decompression or an internal exhaust gas return without complicated modifications to the existing valve train and cylinder head designs.

The invention achieves the above object by the fact that the cam follower is a finger lever that acts at on end on at least one gas exchange valve and is seated at another end via a contact piece on a head of a housing of a support element, which housing extends for axial movement in a reception bore of a cylinder head, wherein a bore extends from a bottom of the housing in direction of the head, a pressure piston that is axially movable relative to the housing extends in a lower section of the bore, the support element being mounted through a lower front end of the pressure piston on a base of the reception bore of the cylinder head, wherein a high pressure chamber for hydraulic medium is formed between an upper front end of the pressure piston and a ring part that is fixedly arranged on the housing and is situated above the upper front end, wherein for generating the additional lift, the high pressure chamber can be flooded with hydraulic fluid such that the housing moves outwards relative to the pressure piston and is supported on the accumulated hydraulic medium column, and wherein for deactivating the additional lift, the high pressure of the hydraulic medium in the high pressure chamber can be reduced such that the housing retreats relative to the pressure piston.

Thus, a valve train particularly for realizing a decompression or an exhaust gas return is created that is free of the aforesaid drawbacks. Preferably it is intended to use the valve train in connection with an outlet valve but its use with an inlet valve is likewise imaginable and intended. For example, in the case of currently used start-stop devices of internal combustion engines, it is required that, after a stop phase, the engine reaches a high rotational speed adequately fast and with a minimum of resistance. In this connection, a decompression during the compression stroke on the outlet valve proves to be advantageous. It is likewise possible to transport residual gas into the combustion chamber (internal exhaust gas return (AGR)) through an additional opening of the outlet valve during the suction stroke, and this creates advantages for the combustion engine such as a lowering of the combustion temperature which leads to a reduction of nitric oxides. If necessary, it is also possible to use the proposed device for pressing residual gas into the suction tract. The valve train can be used particularly advantageously in a quality-controlled internal combustion engine, but not exclusively.

According to a preferred embodiment of the invention, the high pressure chamber is to be closed in direction of a reservoir situated above the high pressure chamber by using a non-return valve, known from hydraulic lash adjusters. It is of course also imaginable to obtain a forced opening of the non-return valve for deactivating the additional lift while creating a zero lift for the housing of the support element by using a slide that is operated, for instance, electromagnetically by an external means. However, the invention preferably proposes to provide, in the reservoir, a locking slide that can be moved away from (or towards the non-return valve) by hydraulic medium pressure, which locking slide is guided in the bore of the housing and forcedly opens the non-return valve through a compression spring force at a reduced hydraulic medium pressure, so that the high pressure chamber almost collapses and the additional lift function is thus deactivated so that an oscillating zero lift of the housing relative to the pressure chamber is created.

For a simple flooding of the reservoir of the housing of the support element, according to one proposition, the support element comprises at least one passage in the form of a bore that is fed out of a pressure oil duct that extends in the cylinder head. As a pressure oil duct it is possible, e.g. to use that duct that was provided in hitherto used cylinder heads for supplying pressure oil to the hydraulic support elements.

Further advantageous developments of the invention concern a configuration of a head region of the housing. Thus, according to one variant, the head region can comprise a semi-circular recess into which a spherical head of a contact piece of the finger lever engages. The contact piece can extend integrally from the finger lever or, for example, form a part of a lash adjusting screw.

As an alternative to the above, the invention proposes to configure the head itself with a semi-circular-like shape, so that the finger lever bears against the head through a semi-circular recess. In this case, but also in the aforesaid development, the head can also be a part of a separate cylinder piece that is connected fixedly to the housing, for example, by pressing-on or welding.

The invention finally proposes providing in the head region at least one venting opening leading out of the reservoir. In this way, undesired air accumulated in the support element can escape. At the same time, this results in a good lubrication of the mounting region to the finger lever.

BRIEF DESCRIPTION OF THE DRAWINGS

The invention will now be described more closely with reference to the drawing.

DETAILED DESCRIPTION OF THE PREFERRED EMBODIMENTS

Figure 1:
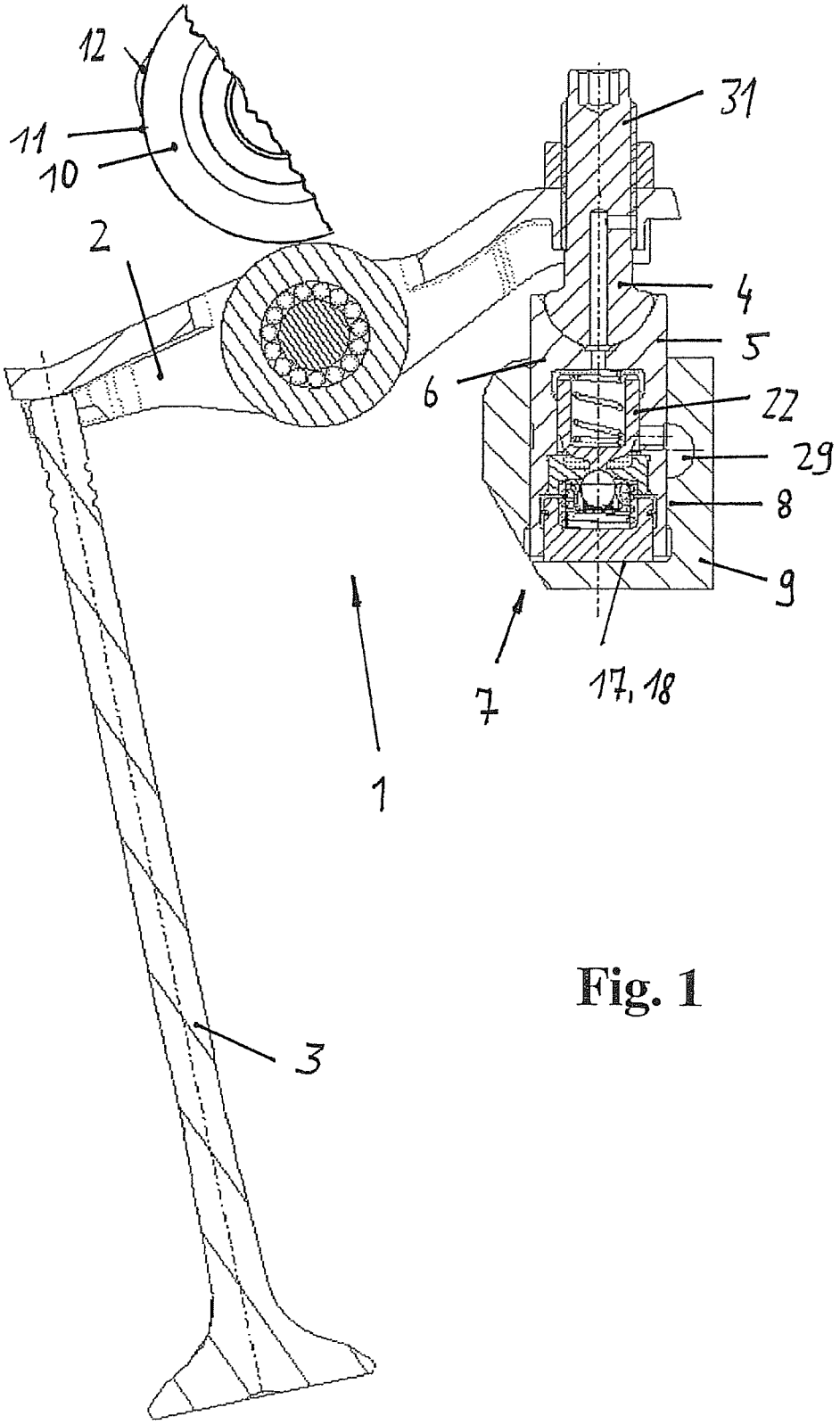
FIG. 1 shows an overall view of the valve train.
Figure 3:
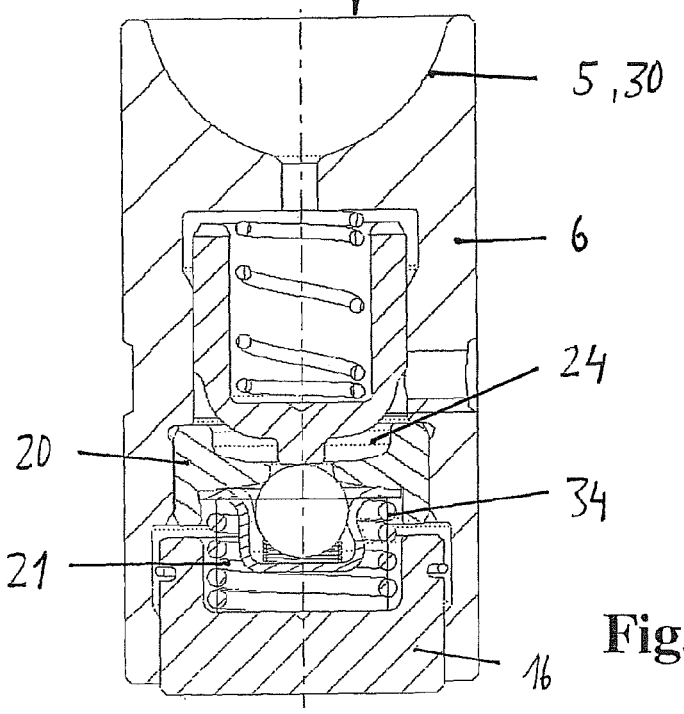
FIG. 3 shows a second variant of the support element of the valve train comprising a locking slide

FIG. 1 illustrates a valve train 1 of an internal combustion engine. The valve train 1 comprises a finger lever 2 which acts at one end on a gas exchange valve 3 and which is seated at another end via a contact piece 4, configured in the present case as a lash adjusting screw 31, on a head 5 (see also FIG. 3) of a housing 6 of a support element 7, said head 5 comprising a semi-circular recess 30.

The housing 6 extends for axial movement in a reception bore 8 of a cylinder head 9. It can be seen further that the finger lever 2 is loaded by a cam 10 from whose base circle 11 an additional cam piece 12 for generating an additional lift of the gas exchange valve 3 projects.

A stepped bore 14 extends from a bottom 13 of the housing 6 in direction of the head. A pressure piston 16 which is axially movable relative to the housing 6 extends in a lower section 15 of the bore 14, and a leak gap for hydraulic medium is formed between an outer wall of the pressure piston 16 and the bore 14. Through a lower front end 17, the pressure piston 16 is permanently mounted on a base 18 of the reception bore 8 of the cylinder head 9.

A high pressure chamber 21 for hydraulic medium is formed between an upper front end 19 of the pressure piston 16 and a ring part 20 that is fixedly arranged on the housing 6 while being situated above the upper front end 19. The ring part 20 comprises a non-return valve 23 configured as a ball valve that opens into the high pressure chamber 21. A compression spring 34 that is braced between the ring part 20 and the pressure piston 16 extends in the high pressure chamber 21.

The non-return valve 23 is forcedly open in direction of the high pressure chamber 21 through a locking slide 22. The locking slide 22 extends in a reservoir 24 formed above the ring part 20 and constitutes a piston that is guided in the bore 14 of the housing 6. The locking slide 22 is biased through the force of a compression spring means 25 in a direction towards the non-return valve 23. The compression spring means 25 is supported on a head side base 26 of the bore 14 of the housing 6.

The aforesaid reservoir 24 serves to supply hydraulic medium to the high pressure chamber 21. For generating the additional lift of the gas exchange valve during a cam base circle phase 11, the locking slide 22 can be brought out of contact with the non-return valve 23 by flooding the reservoir 24 through a pressure duct 29 situated in the cylinder head 9, so that the housing 6, in its extended state and with closed non-return valve 23, is supported on the pressure medium column in the high pressure chamber 21.

For deactivating the additional lift, the prevailing hydraulic medium pressure is reduced so far that the piston-like locking slide 22, via its lug 27, opens the non-return valve 23 through the force of its compression spring means 25. This leads so to say to a collapse of the high pressure chamber 21 and the housing 6 thus performs a zero lift relative to the pressure piston 16.

Figure 2:
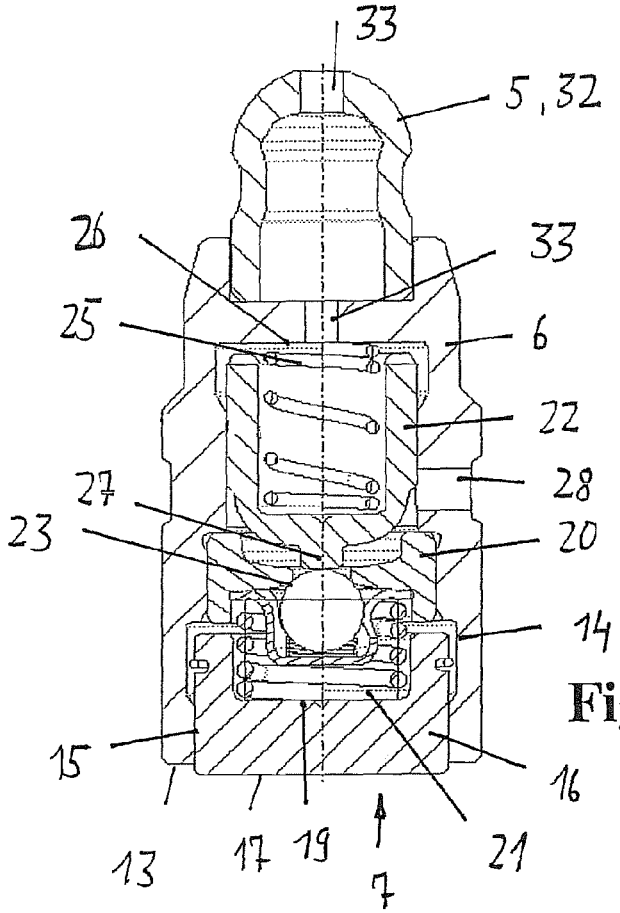
FIG. 2 shows a first variant of the support element of the valve train comprising a locking slide.

FIG. 2 discloses an alternative configuration of the head 5 of the housing 6. The head 5 comprises a ball-like vaulting and is a part of a separate cylinder piece 32 that is fixedly connected to the housing 6. Thus, the counterpart in the finger lever 2 is configured as a semi-circular recess (not shown).

FIG. 2 further shows two vent openings 33 in the head 5. Through these openings, the undesired air accumulated in the reservoir 24 can escape to the exterior. A lubrication of the side of the mounting point directed towards the head is also realized through these openings.

LIST OF REFERENCE NUMERALS

1 Valve train
2 Finger lever
3 Gas exchange valve
4 Contact piece
5 Head
6 Housing
7 Support element
8 Reception bore
9 Cylinder head
10 Cam
11 Base circle
12 Additional cam piece
13 Bottom
14 Bore of housing
15 Section
16 Pressure piston
17 Lower front end
18 Base
19 Upper front end
20 Ring part
21 High pressure chamber
22 Locking slide
23 Non-return valve
24 Reservoir
25 Compression spring means
26 Base
27 Lug
28 Passage
29 Pressure duct
30 Semi-circular recess
31 Lash adjusting screw
32 Vaulting
33 Vent opening
34 Compression spring

The invention claimed is:

1. A valve train of an internal combustion engine comprising a finger lever which acts at one end on at least one gas exchange valve and is seated at another end through a contact piece on a head of a housing of a support element, the housing extends for axial movement in a reception bore of a cylinder head, said finger lever being loaded by a cam having a base circle from which an additional cam piece projects in a fixed manner for generating an additional lift of the gas exchange valve, a bore extends in direction of the head from a bottom of the housing, a pressure piston which is axially movable relative to the housing extends in a lower section of the bore, the support element being mounted through a lower front end of the pressure piston on a base of the reception bore of the cylinder head, a high pressure chamber for a hydraulic medium is formed between an upper front end of the pressure piston and a ring part that is fixedly arranged on the housing and is situated above the upper front end, and for generating the additional lift, the high pressure chamber is flooded with hydraulic fluid such that the housing moves outwards relative to the pressure piston and is supported on a hydraulic medium column accumulated in the high pressure chamber, and for deactivating the additional lift, the high pressure of the hydraulic medium in the high pressure chamber is reduced such that the housing retreats relative to the pressure piston.

2. The valve train according to claim 1, wherein the ring part comprises a non-return valve that is forcedly opened in a direction of the high pressure chamber through a locking slide, a compression spring is supported between the pressure piston and the ring part, a reservoir serving to supply hydraulic medium to the high pressure chamber is situated axially above the ring part, and for generating the additional lift, the locking slide is brought out of contact with the non-return valve, so that, in an extended state, the housing is supported via the hydraulic medium column in the high pressure chamber, and for deactivating the additional lift, the non-return valve is opened through the locking slide so that, in a collapsed state of the high pressure chamber, the housing performs a zero lift relative to the pressure piston.

3. The valve train according to claim 2, wherein the locking slide is biased hydraulically in at least a direction of travel.

4. The valve train according to claim 3, wherein the locking slide extends within the reservoir and constitutes a piston that is guided in the bore of the housing, said piston being biased in a direction of the non-return valve through a force of a compression spring that is supported at least indirectly on a head side base of the bore of the housing.

5. The valve train according to claim 4, wherein the housing comprises at least one hydraulic medium passage to the reservoir, the passage communicates with a hydraulic medium pressure duct leading into the reception bore of the cylinder head, and for deactivating the locking slide the reservoir is supplied with a hydraulic medium high pressure out of the pressure duct so that the locking slide, acting against a force of the compression spring, is out of contact with the non-return valve, so that the support element operates in a manner of a hydraulic lash adjuster, and for activating the locking slide, the high pressure of the hydraulic medium out of the pressure duct is reduced, so that, through the force of the compression spring, the locking slide opens the non-return valve.

6. The valve train according to claim 1, wherein, for making contact with the non-return valve, the locking slide comprises a central protruding lug.

7. The valve train according to claim 1, wherein the head of the housing comprises a semi-circular recess in which a spherical head projecting from the finger lever is mounted as a contact piece.

8. The valve train according to claim 7, wherein the contact piece configured as the spherical head is part of a lash adjusting screw that is guided by the finger lever.

9. The valve train according to claim 1, wherein, for realizing the head of the housing, the housing comprises a ball-like vaulting on which the contact piece extending in a lower side of the finger lever and configured as a semi-circular recess is mounted.

10. The valve train according to claim 9, wherein the head of the housing is part of a separate cylinder piece that is fixedly connected to the housing.

11. The valve train according to claim 1, wherein a vent opening extends through the head of the housing.

* * * * *